United States Patent [19]

Vogel

[11] Patent Number: 4,799,443

[45] Date of Patent: Jan. 24, 1989

[54] SWING SAIL BOAT

[76] Inventor: Ferdinand L. Vogel, Voorhees Rd.,RD 3, Whitehouse Station, N.J. 08889

[21] Appl. No.: 942,936

[22] Filed: Dec. 19, 1986

Related U.S. Application Data

[63] Continuation of Ser. No. 743,752, Jun. 12, 1985, abandoned.

[51] Int. Cl.[4] ..... B63H 9/06

[52] U.S. Cl. ..... 114/39.1; 114/91; 114/102

[58] Field of Search ..... 114/39, 39.1, 39.2, 114/90, 91, 97, 98, 102; 280/213, 810

[56] References Cited

U.S. PATENT DOCUMENTS

| | | | |
|---|---|---|---|
| 1,613,890 | 1/1927 | Herreshoff . | |
| 1,670,936 | 5/1928 | McIntyre et al. | 114/102 |
| 3,090,340 | 5/1963 | McCutchen et al. | 114/102 |
| 3,487,800 | 1/1970 | Schweitzer et al. | 114/39 |
| 3,903,827 | 9/1975 | Marcil | 114/143 |
| 4,005,669 | 2/1977 | Klemm | 114/91 |
| 4,016,823 | 4/1977 | Davis | 114/90 |
| 4,044,702 | 8/1977 | Jamieson | 114/102 |
| 4,068,607 | 1/1978 | Harmon | 114/102 |
| 4,117,797 | 10/1978 | Kelly et al. | 114/91 |
| 4,230,060 | 10/1980 | McCoy | 114/39 |
| 4,345,535 | 8/1982 | Ross | 114/122 |

FOREIGN PATENT DOCUMENTS

| | | | |
|---|---|---|---|
| WO85/02158 | 5/1985 | European Pat. Off. . | |
| 253470 | 11/1911 | Fed. Rep. of Germany . | |
| 2498554 | 7/1982 | France | 114/102 |
| 2535673 | 5/1984 | France | 114/91 |

OTHER PUBLICATIONS

Gurney, "Offshore Racing," Yachting, March 1985, pp. 68–71.

*Primary Examiner*—Joseph F. Peters, Jr.
*Assistant Examiner*—Paul E. Salmon
*Attorney, Agent, or Firm*—Kenyon & Kenyon

[57] ABSTRACT

A novel rigging for a sailboat is disclosed in which the mainsail is mounted between a luff boom and a foot boom, the luff boom being attached to the top of the mast by a fitting that allows rotation at least about a vertical axis parallel to the mast and about a tilt axis normal to the mast such that the luff boom can tilt out of the vertical. The fitting is joined to the luff boom at a pivot point above the center of effort of the sail, and not necessarily at its head. A tack sheet and a clew sheet restrict the tilt of the luff boom and its rotation around the mast. A jib sail, too, may be tiltably mounted by attaching it to a luff boom which is suspended at its head from a high point on the mast. The mast may be retractable or extendable and either luff boom may be given a streamlined cross section.

13 Claims, 5 Drawing Sheets

SWING SAIL BOAT

This application is a continuation, of application Ser. No. 743,752, filed June 12, 1985, abandoned.

FIELD OF THE INVENTION

This invention relates to sailboats and more particularly to a rigging configuration for sailboats.

BRIEF DESCRIPTION OF THE PRIOR ART

Numerous configurations for the rigging of sailboats have been developed over the years. A type of rigging prevalent today includes a mainsail roughly in the shape of a right triangle affixed along the entire length of a vertical edge (the "luff" edge) to a stationary vertical mast. The entire length of a horizontal edge (the "foot") is affixed to a boom. The boom is pivotably mounted to the mast at the right angle (the "tack") of the sail such that the opposite end of the boom (at the "clew" of the sail) can swing transversely across the stern of the boat. A mainsheet extends between the boom and a point on the deck at the approximate horizontal center thereof to prevent the boom from swinging outward beyond a desired angle.

Conventionally rigged sailboats can also include a jib which is a foresail, also roughly triangular in shape, attached along its entire luff edge to a forestay extending between the bow and a high point on the mast.

A jib usually does not include a foot boom; instead a jibsheet is attached to the clew of the sail and is fastened adjustably to the deck near the leeward side of the cockpit.

A sailboat may also include other sails, such as a mizzen or a staysail. The present invention, while described primarily with respect to boats rigged as described above, is equally applicable to many boats with other types of rigging.

When a sailboat is running before the wind, its operation is fairly simple. That is, the more sail area that can be presented to the wind, normal to the wind direction, the greater the force propelling the boat forward. Since the propelling force is effectively applied at a point high above the deck, however, this force also creates a pitching moment which tends to upset the boat's longitudinal trim by forcing the bow downward into the water. The effect of the pitching moment counters the propelling force to some degree and limits the ultimate forward velocity of the boat. In serious cases, the pitching moment can force the bow of the boat so far into the water that a high wave can cause the boat to capsize. See *Yachting*, March 1985, pp. 68–71 for a graphic illustration of this.

When a sailboat is moving across the wind or into the wind, additional complications arise which seriously affect its performance. These factors, which are covered in detail in two books by C. A. Marchaj, *Sailing Theory and Practice* (1964) and *Aero-Dynamics of Sailing* (1979), both published by Dodd, Mead and Company of New York City, are briefly explained in the following discussion as they pertain to the invention.

Heeling Forces

When sailing close to the wind, the mainsail takes on an airfoil shape due to the difference in pressure that develops on the outside (forward or leeward) surface and the inside (sternward or windward) surface. This difference in pressure creates a force effectively applied normal to a point on the sail known as the center of effort. This force ($F_T$) has components in the longitudinal and transverse directions relative to the hull of the boat. The longitudinal component tends to propel the boat in a forward direction, whereas the transverse force tends to cause the boat to drift sideways. The transverse force also acts as a couple with the center of lateral resistance of the boat to cause the boat to roll about a longitudinal axis away from the wind, a motion referred to as heeling. Since the hull of a boat generally is not perfectly symmetrical below the deck line, heeling causes changes in the drag of the hull moving forward through the water as the angle of heel is changed. Thus, a hull designed to have minimum drag at one angle of heel will not be operating at maximum efficiency at another angle. Heeling can also be uncomfortable to some passengers and, in the case of wind-driven or wind-assisted cargo ships (see Fishman, "A Fresh Wind for Sail Power," *New York Times*, Sect. 6, Page 166 Dec., 1981)), can cause cargo to break loose from its security and result in damage.

Hull Immersion

The transverse force on the sail that causes heeling is part of a torque acting about a longitudinal axis of the boat. At zero transverse force, the boat is in the upright position and, as the force is increased, the boat heels over. As the mast moves out of the vertical position, the transverse force increasingly develops a component directed downward relative to the water, which has the effect of forcing the hull deeper into the water. This increases the area of the hull wetted by the water, thereby increasing the drag of the hull.

Longitudinal Trim

The total force on the sail is directed normal to a plane of the sail at its center of effort, which is approximately at its geometric center. The longitudinal portion of this force propels the boat forward, but also creates a torque which pushes the bow of the boat into the water with respect to the stern. This is the same disturbance to longitudinal trim which was described above with respect to a boat travelling downwind. It causes the hull to move forward in the water in a disposition other than that designed for maximum efficiency.

Shape of Sail

When sailing very close to the wind, the airfoil of a sail which provides the propelling force to a boat produces a larger total force on a tall, narrow sail than on a short, broad one of the same area. Thus, to get the greatest propelling force from a given sail area, the sail must be as tall as possible. This effect is measured by the aspect ratio defined as follows:

$$A.R. = L^2/S_A$$

where

L = height of sail $S_A$ = area of sail.

However, a sail with a large aspect ratio also has a high center of effort and therefore a greater heeling and pitching torque. These torques therefore impose a limit on the highest aspect ratios that can be usefully attained. Aspect ratios between 1.0 and 2.0 are on the low side, while 4.0 to 4.5 are considered to be the highest that can usefully be obtained under normal circumstances.

Directional Balance

The center of resistance of the hull to the motion of the hull in the water is located close to the fore-aft middle of the boat and approximately at the middle of the keel or centerboard. The lateral dragging force of the water on the boat is effectively applied at this point. This force, when projected onto a horizontal (relative to the water) plane together with the force-on-the-sail vector, defines a torque or couple which determines the directional balance of the boat. When the force-on-the-sail vector, extended in both directions and projected onto the horizontal plane, lies before a similar projection of the resistance force vector, there is a tendency for the boat to turn off the wind, and the helmsman must compensate by holding the boat into the wind. On the other hand, when the projected and extended sail force vector lies astern of the resistance vector, there is a tendency for the boat to turn into the wind, and the helmsman must compensate by holding the boat in the downwind direction. The magnitudes of the torques determine the ease with which the helmsman can steer the boat, with small torques providing good directional balance or a "light helm." A boat trimmed with poor directional balance has the added disadvantage of increased rudder drag.

Mast-Sail Interactions

In one conventional arrangement, the sail is fastened to the mast by means of slides that ride in a track on the mast, and so the sail always bears the same geometric relationship to the mast regardless of wind direction. The flow of wind around the mast creates eddies and other flow disturbances that reduce the effectiveness of the airfoil of the sail in generating aerodynamic force. The effect of the mast on sail efficiency can be quite substantial. It can be reduced for a single wind direction by giving the mast an appropriately streamlined shape, such as that of a teardrop, but this would exacerbate the problem for another wind direction.

One solution to this problem is to provide a mast of streamlined cross section, and allow the mast to rotate about a vertical axis depending on the wind direction. See U.S. Pat. No. 4,230,060 to McCoy. This arrangement places a heavy strain on the pivot point at the base of the mast and requires special rotation devices aloft where the stays and spreaders are attached to the mast.

In the past, attempts were made to improve the operation of sailboats by allowing the mast to slant under wind pressure. See, for example, U.S. Pat. No. 3,487,800 to Schweitzer, which discloses a sailboard having such a pivotable mast. For larger boats, the pivotable mast was frequently accompanied by a keel which would pivot in response to the slant of the mast so as to counteract the heel of the boat. This type of arrangement is shown in U.S. Pat. No. 3,903,827 to Marcil and U.S. Pat. No. 4,117,797 to Kelly.

Other arrangements that have been proposed for reducing the deleterious forces described above include a kite or wing sail such as that shown in U.S. Pat. No. 4,068,607 to Harmon.

U.S. Pat. No. 4,345,535 to Ross shows an apparatus for countering the heeling torque. In this apparatus, a mast is mounted on a hull so as to permit the mast to pivot, at its base, either to port or starboard in response to the wind. By mechanical means the pivoting of the mast is used to apply a vertically downward force on the windward side of the hull, thereby tending to right the boat. The mainsail is mounted on an auxiliary mast suspended as a pendulum from the top of the primary mast. The lower end of the auxiliary mast rides in a track which permits the auxiliary mast to swing to port or starboard only, by an amount determined by the pivot angle of the primary mast. Ross also shows a foresail mounted on a jib foot boom which can pivot at the end thereof attached to the primary mast.

U.S. Pat. No. 4,005,669 to Klemm also discloses a mast which is tiltable as a pendulum. Like Ross, however, the movement of the base of the mast is limited by a track to the port-starboard direction. See also the patents listed as prior art in Klemm.

U.S. Pat. No. 4,044,702 to Jamieson discloses an arrangement comprising a vertical mast with a short, fixed-length boomlet rotatably attached to the base thereof. (FIGS. 8–11). The tack end of a longer foot boom is attached to the free end of the boomlet such that the foot boom can rotate with respect to the boomlet about an axis parallel to the mast. The sail is then attached at its three corners respectively to the top of the mast, the tack of the foot boom, and the clew of the foot boom. An alternative embodiment is shown in FIG. 12 of Jamieson. This arrangement is not intended to reduce the deleterious forces described above, but rather to take advantage of a slot effect created when the sail is positioned aweather of the mast.

SUMMARY OF THE INVENTION

An objective of this invention is to provide a sailboat which reduces or eliminates some or all of the above-described disadvantages.

Another objective of this invention is to reduce or control the heeling of a sailboat when sailing close to the wind.

Another objective of this invention is to reduce the sidewise, downwind motion of a sailboat when sailing close to the wind.

Still another objective of this invention is to reduce or partially reverse the immersion of the hull when sailing close to the wind.

Still another objective of this invention is to permit the use of a sail of higher aspect ratio and total aerodynamic force than is possible with conventional designs.

Still another objective of this invention is to reduce the disturbing effect of the mast on the flow of air on the lee side of the sail.

Still another objective of this invention is to improve the longitudinal trim of the hull of a sailboat.

Still another objective of this invention is to improve the directional balance of a sailboat.

Still another objective of this invention is to permit the sail to be raised higher above the water.

Still another objective of this invention is to provide a luff boom of cross-sectional shape that will produce minimum disturbance on the sail.

Still another objective of this invention is to provide increased control of steering when running before the wind in a following sea.

Still another objective of this invention is to provide increased forward thrust on the sail by reducing the tendency to stall as a result of increasing the angle between wind and the leading edge or luff of the sail.

Still another objective of this invention is to allow the design of a more efficient jib.

Still another objective of this invention is to allow the design of a jib with a curved luff.

The aforementioned objectives and others can be achieved by mounting the mainsail between two booms: one (the "luff boom") generally vertical running along the luff of the sail from tack to head, and the other (the "foot boom") generally horizontal running along the foot of the sail from tack to clew. The luff boom may have a streamlined cross section with the sail fastened either inside or close to the trailing edge thereof. The luff boom may also be inserted in a pocket in the luff edge of the sail. The luff boom is attached to the mast by a fitting that allows rotation about (1) a vertical axis parallel to the mast, (2) a horizontal axis normal to the mast and passing through the fitting, and, if desired, (3) the pivotal point on the luff boom, which is to say that it can rotate in its own plane. The fitting is joined to the luff boom at a pivot point above the center of effort of the sail. Since the fitting can be at the top of a shortened mast, no part of the mast need be on the lee side of the sail when the luff boom is swung or tilted out of the vertical position.

To fully position the sail, two sheets are used—one fastened near each end of the foot boom. Since the mast in this invention may be free-standing without stays or shrouds, provision can be made to raise or lower it along its vertical axis by having it composed of telescoping sections. See U.S. Pat. No. 4,016,823 to Davis. The mast could then be extended or retracted by having external screw threads on the internal member and matching internal screw threads on the external member so that as one member is rotated the mast extends or retracts.

If the boat includes a jib, it too can be swingably or tiltably mounted. In this situation, the luff edge of the jib is affixed to a luff boom which is pivotably mounted at its head end to a high point on the mast. The luff boom may have a streamlined cross section. A foot boom may be desirable under some circumstances, but is not required. A jib tack sheet is secured near the tack end of the luff boom and runs through a swivel block on the centerline of the deck near the bow. A jib clew sheet is fastened to the clew of the jib and runs through a swivel block mounted on the centerline of the deck immediately before the mast. The swivel block may also be mounted next to the cockpit. Thus, like the mainsail, a tiltably mounted jib can be operated either in the conventional manner or with the luff boom tilted toward the leeward side of the boat. Other sails, too, can be tiltably mounted.

BRIEF DESCRIPTION OF THE DRAWINGS

The invention will be more clearly understood by reference to the accompanying drawings, in which.

DETAILED DESCRIPTION OF THE INVENTION

An embodiment of the invention in comparison with prior art arrangements will now be described with reference to the accompanying drawings, throughout which like parts are given like designations. Though many of the advantages of the invention are presented by reference to the physical forces involved, it should be recognized that such references are greatly simplified to more clearly illustrate the appropriate phenomena.

Figure 1:
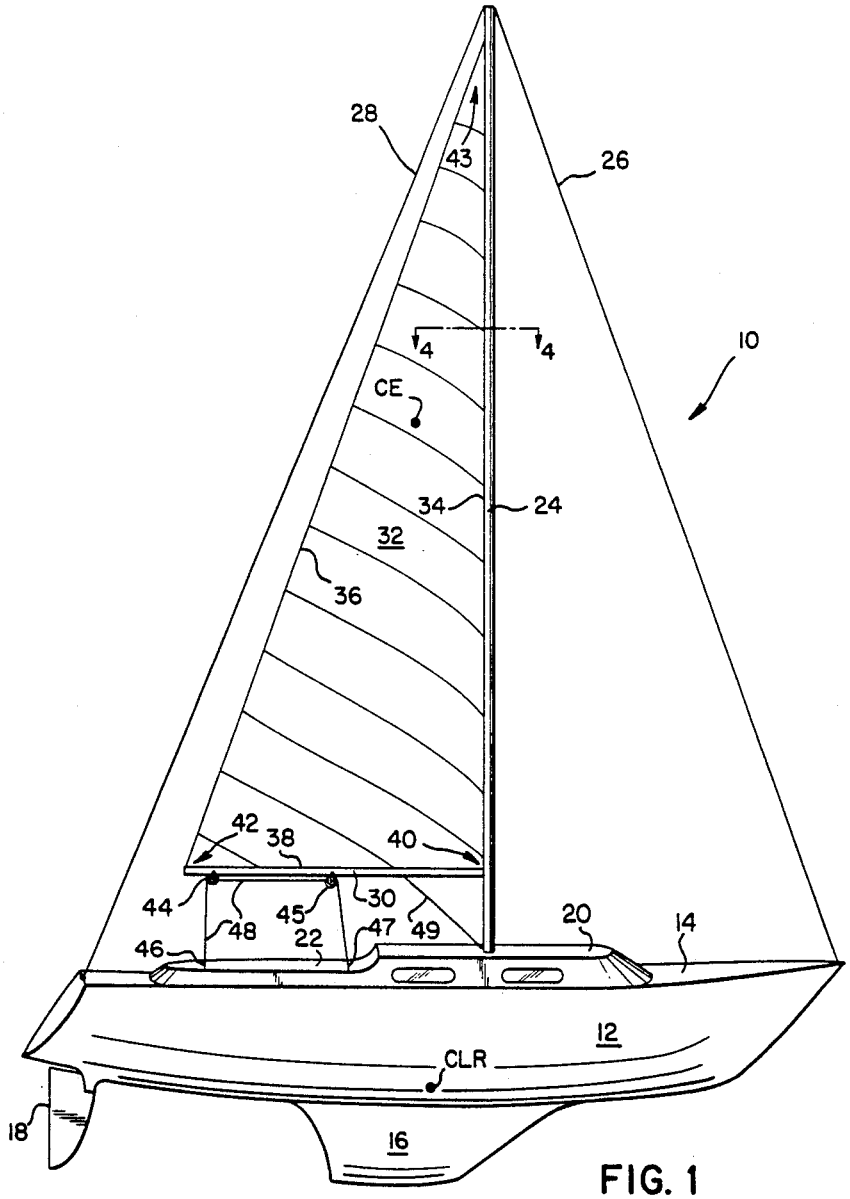
FIG. 1 PRIOR ART
FIG. 1 is a side view of a prior art sailboat rigged in a conventional manner.

In FIG. 1 is shown a side view of a prior art sailboat 10 with a mainsail rigged in a conventional manner. It comprises a hull 12 having a deck 14 on the top surface thereof, and a keel 16 and a rudder 18 depending from the bottom of the hull 12. Internal to the hull 12 is a cockpit 22, and a cabin (not shown) with a roof 20. A mast 24 is affixed to the hull 12 and extends through the cabin roof 20 substantially vertically with respect to the hull 12. A forestay 26 extends from the top of the mast 24 to a point at the bow of the boat 10, and an backstay 28 extends from the top of the mast 24 to a point at the stern of the boat on the centerline thereof. The forestay 26 and the backstay 28 are tightly secured so as to oppose sternward and forward, respectively, bending of the mast. Additional stays (not shown) oppose sideways bending of the mast. Pivotably mounted to the rear of the mast 24, at a point above the cabin roof 20, is a boom 30. For reasons which will become apparent later, the boom 30 will sometimes be referred to herein as a foot boom. The mounting of the boom 30 to the mast 24 is such as to permit the boom 30 to deviate horizontally from the centerline of the boat by approximately 90° in each direction, and to deviate upward by approximately 20°. A mainsail 32, having a luff edge 34, a leach edge 36, a foot 38, a tack 40 between the luff 34 and the foot 38, and a clew 42 between the foot 38 and the leach 36, and a head 43 at the top of the sail 32, is mounted between the mast 24 and the boom 30. The luff edge 34 may be secured inside a slot (not shown) in the top of the boom 30 and extending most of the length thereof. A mainsheet 48 is secured to a shackle 46 near the rear of the cockpit 22 and extends upward to a block 44 mounted near the clew end of the boom 30. The mainsheet 48 passes through the block 44 and through a second block 45 located near the middle of the boom 30, and down to a locking block 47 located near the front of the cockpit 22. The block 47 is designed to permit the length of the mainsheet 48 to be adjusted and locked at a desired length. A boom vang 49 is shown extending between a point on the boom 30 forward of the block 45, and the base of the mast 24. Also shown in FIG. 1 is the center of effort CE of the wind on the sail 32 and the center of lateral resistance CLR of the boat 10 in the water. This sailboat 10 is subject to the disadvantages previously described.

Figure 2:
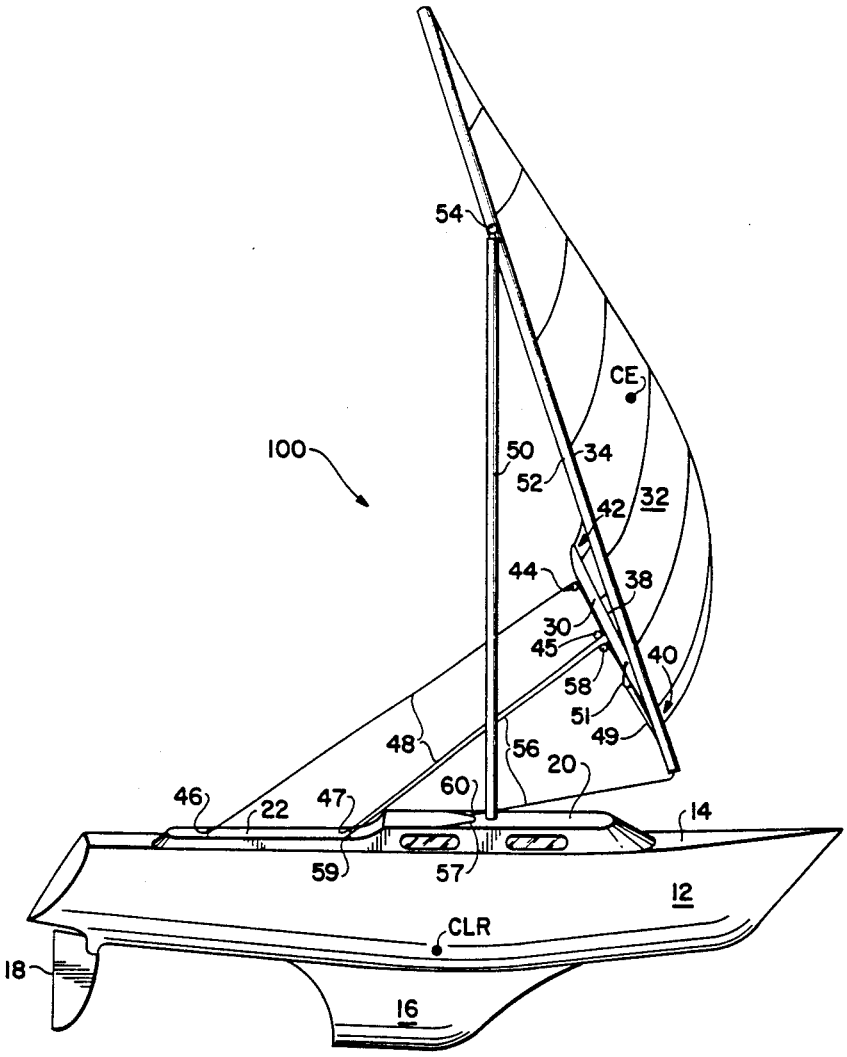
FIG. 2 is a side view of a sailboat according to the present invention in operation running before the wind.

In FIG. 2 there is shown a sailboat 100 according to the present invention. The mast 24 is replaced by a shorter, sturdier mast 50, and the stays and shrouds are removed. The luff edge 34 of the mainsail 32 is affixed along its entire length to a luff boom 52 which is attached at a pivot point to the top of the mast 50 via a fitting 54. The fitting 54 permits the mainsail 32 to tilt about an axis normal to mast 50 and lying substantially in the plane of the sail, and also to rotate about the vertical axis of the mast 50. Although not necessary to the invention, the fitting 54 of the present embodiment also permits rotation in the plane of the sail. The pivot point on the luff boom 52 at which the fitting 54 is attached is located above the center of effort CE as projected onto the luff boom 52. The mainsail 32 extends from the trailing edge of the luff boom 52 whereas the fitting 54 is attached to the leading edge.

The foot boom 30, which was attached to the mast 24 in the prior art arrangement of FIG. 1, is now attached near the lower (tack) end of the luff boom 52 in the same manner. The luff boom 52 extends down below the point where the foot boom 30 is attached. The boom vang 49 is attached between the lower end of the luff boom 52 and a fairlead 51 located on the foot boom 30 between the block 45 and the luff boom 52. The fairlead 51 is needed in the present embodiment to prevent the boom vang 49 from interfering with a tack sheet, to be described below. As in the prior art arrangement, the mainsheet 48 is attached to the shackle 46 near the rear of the cockpit 22, passes through the two blocks 44 and 45 on the foot boom 30, and is held taut by the locking block 47 near the front of the cockpit 22. To avoid confusion, the mainsheet 48 will sometimes be referred to hereinafter as the clew sheet or main clew sheet 48. A new tack sheet 56 is attached to a car 60 which rides on an arcuate track 57. The track 57 is attached to the cabin roof 20 and oriented so that the centerpoint of the arc is disposed on the roof 20 just behind the mast 50, and the two ends of the arc are disposed on the roof 20 aft of the centerpoint of the arc and on either side of the centerline of the boat. The tack sheet 56 extends from the car 60 up to and in through a hole in the lower end of the luff boom 52, out through another hole in the luff boom 52 just below the point where the foot boom 30 is attached, through the fairlead 51, through a block 58 mounted on the foot boom 30 next to the block 45, and down to a locking block 59 mounted near the front of the cockpit 22 next to the locking block 47.

Figure 3:
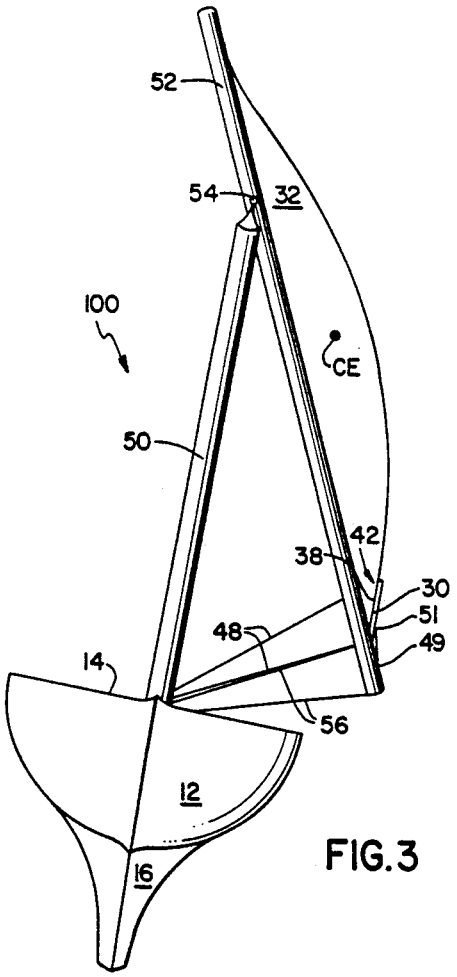
FIG. 3 is a bow view of a sailboat according to the present invention in operation sailing close to the wind.

In its simplest mode of operation, the tack sheet 56 is close hauled so as to prevent the luff boom 52 from tilting away from the mast 50. In this configuration, the operation of the sailboat reduces to that of the prior art arrangement. When the tack sheet is let out to some extent, the advantages of the present invention begin to become important. Since the center of effort CE of the wind on the sail 32 is below the axis of tilt, the force $F_T$ which the wind exerts on the sail urges the sail to tilt, the tack end of the luff boom 52 moving away from the mast. This is illustrated in FIG. 2 for a boat sailing downwind and in FIG. 3 for a boat sailing close to the wind. The luff boom 52 tilts in this manner until the tack sheet 56 becomes taut and restrains further tilting. Since the total force $F_T$ produced by the wind is applied in a direction normal to the plane of the sail 32, any component of $F_T$ in the vertically downward direction will be reduced or cancelled, and could potentially result in a net upward force. The plane of the sail, as that term is used above, varies depending on many factors. See the Marchaj references. However, it is approximately that plane defined by the tack, clew and peak of the sail.

In operation, when running before the wind (see FIG. 2), the tack sheet 56 is let out and the luff boom 52 allowed to tilt forward, so that the mainsail 32 is positioned generally in a plane parallel to the beam of the boat 100, but tilted so as to pass through the top of the mast 50 and a point on the deck 14 forward of the mast 50. When the wind fills the sail from behind, some air will spill out under the foot, but the remainder will generate a force $F_T$ directed generally perpendicular to the plane of the sail 32. The force therefore has an upward vertical component, or more of an upward vertical component than it has on a conventionally rigged sailboat. As long as the center of effort CE is before the pitching axis, this upward component will reduce the pitching torque. The designer can ensure that the center of effort CE is forward of the pitching axis in a known manner by weighting the stern of the hull 12 more than the bow, and/or by placing the mast 50 sufficiently forward consistent with good directional balance.

When sailing close to the wind (see FIG. 3), the tack sheet 56 is again let out, permitting the luff boom 52 to tilt leeward, away from the mast 50. The clew sheet 48 is also let out until a desired trim is obtained. Since the luff boom 52 is both tiltably and rotatably attached to the top of mast 50, the fitting 54 will rotate such that the tilt axis remains approximately parallel to the foot boom 30. The tack (lower) end of the luff boom 52 is now both forward and alee of the mast 50. When the wind comes around the lee side of the sail 32, a pressure differential is created which generates a force $F_T$ directed generally normal to a plane of the sail. This force has components in the forward, lateral and vertical directions. If the boat is not heeling, the vertical component is directed upward. If the boat is heeling, which is entirely possible depending on the trim chosen, the downward vertical component present on a conventional boat will be reduced or cancelled.

This has a number of positive effects. First, when the boat is running before the wind, the pitching torque will be reduced or eliminated if the center of effort CE is forward of the pitching axis. Second, hull immersion caused by the downward component of $F_T$ will be reduced. Third, the heeling torque will be reduced because the portion of $F_T$ directed normal to the torque arm (i.e., normal to a plane passing through the center of effort CE and the heeling axis) is reduced. Additionally, if the mast 50 is retractable as described hereinafter, it can be lowered to reduce the length of the moment arm. This is possible because as the boom 52 tilts, the tack end thereof moves upward and increases the clearance between it and the deck 14 or cabin roof 20.

Fourth, since the magnitude of the portion of $F_T$ in a plane parallel to the water is reduced, the magnitude of the force vectors tending to steer the boat off course is reduced, thereby improving the boat's directional balance. This effect depends in part on the angle of heel. Fifth, since a more upright sail will spill less air when the boat is heeling, it should be possible to sail closer to the wind than is possible on a conventional sailboat. Moreover, on small boats, if the boat is held flat in the water, a hiking strap in the cockpit and a hiking stick on the tiller become unnecessary. The tiller could even be replaced by a wheel for further convenience. On large racing yachts it is no longer necessary to have two wheels, port and starboard.

Figure 4:
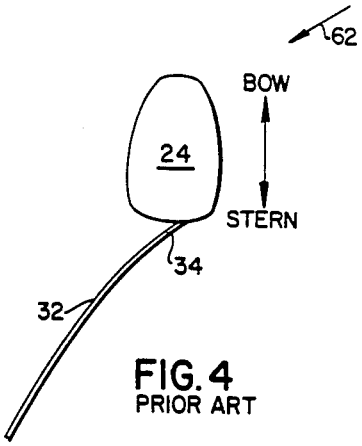
FIG. 4 PRIOR ART
FIG. 4 is a sectional view of the prior art mast shown on the sailboat depicted in FIG. 1.

In FIG. 4 there is shown a sectional view of the mast 24 on the conventionally rigged sailboat 10 of FIG. 1. The mast 24 has an oblong cross section, the major axis of which is parallel to the centerline of the boat. The mainsail 32 is shown secured to the trailing edge of the mast 24 and is extending somewhat to port, which is appropriate for the wind direction depicted as arrow 62. As can be readily seen, the mast 24 blocks a portion of the wind and causes eddies and other disturbances on the lee side of the mainsail 32.

Figure 5:
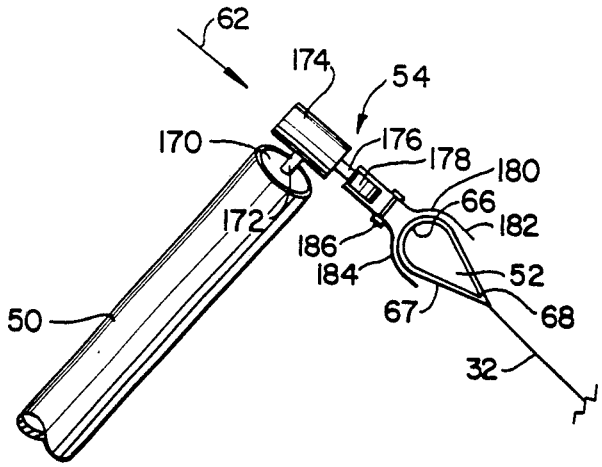
FIG. 5 is a sectional view of the mast, luff boom and pivot joint shown on the sailboat depicted in FIG. 3.

On a sailboat according to the present invention, it is possible to take advantage of known streamlining technology. In FIG. 5, there is shown a sectional view of the mast 50, the fitting 54, the luff boom 52, and the mainsail 32, all of the sailboat 100 depicted in FIGS. 2 and 3, and all positioned appropriately for the wind direction shown by arrow 62. The luff boom 52 has a teardrop shaped cross section, the leading (rounded) edge 66 of which is directed windward and is tiltably attached to the mast 50 through the fitting 54 to be described in more detail below. The luff boom 52 is disposed inside a pocket 67 formed in the luff edge of the mainsail 32, so that the mainsail 32 extends from the trailing (pointed) edge 68 of the luff boom 52. Since the fitting 54 is mounted rotatably about the vertical axis of the mast 50, it can be seen that the luff boom 52 will rotate about that axis until its leading edge 66 is directed substantially windward, thereby causing minimum disturbance to the wind flow for virtually any wind direction. Moreover, as is better seen in FIG. 3, the mast 50 causes no disturbance to the wind flow on the leeward side of the mainsail 32 because the tilt axis is at the top of the mast 50. Any disturbance caused by the mast 50 occurs on the windward side only, where a smooth flow is less important.

In the embodiment so far described, the mast 50 is freestanding, without stays or shrouds (except possibly a forestay). It must therefore be made of high strength material. For large boats a carbon fiber composite may be required, but for smaller boats an aluminum alloy will suffice. In another embodiment it might be possible to use a weaker material and add shrouds, such as by continuing the mast above the fitting 54 to a point higher than the highest point reachable by the top of the luff boom 52. This would sacrifice some of the advantages of the invention, but is nevertheless within its scope.

A specific embodiment of the fitting 54 will now be described with reference to FIG. 5. Mounted inside the mast 50 at the top thereof is a vertical support bearing (not shown) comprising two bearing rings, one disposed just inside the mast 50 and one disposed several inches down. A retaining ring 170 is visible in FIG. 5 at the top of the mast 50. A shaft 172 passes through the two bearing rings and the retaining ring 170 and is welded to the side of a cylindrical container 174. Inside the container 174 is a horizontal support bearing (not shown), comprising two additional bearing rings mounted just inside the two opposite ends of the container 174. A second shaft 176 passes through these two additional bearing rings and protrudes out one end of the container 174. The protruding end of the second shaft 176 is welded to the side of a cylinder 178. A clamp 180 comprises two side plates 182 and 184 which are rotatably attached to the two opposite ends of the cylinder 178, so as to permit the clamp to rotate about the axis of such cylinder. The two plates 182 and 184 extend radially out to one side of the cylinder 178 and clamp onto either side of the luff boom 52. Three bolts (one shown as 186) traverse the space between the two side plates 182 and 184, at a point between the cylinder 178 and the luff boom 52, and may be tightened to secure the luff boom 52 between the two plates. In operation, the vertical support bearing inside the mast 50 permits the luff boom 52 to rotate about the vertical mast axis; the horizontal support bearing inside the container 174 permits rotation about a tilt axis normal to the mast; and the mounting of the clamp 180 to the cylinder 178 permits rotation of the luff boom 52 in the plane of the sail.

Figure 6:
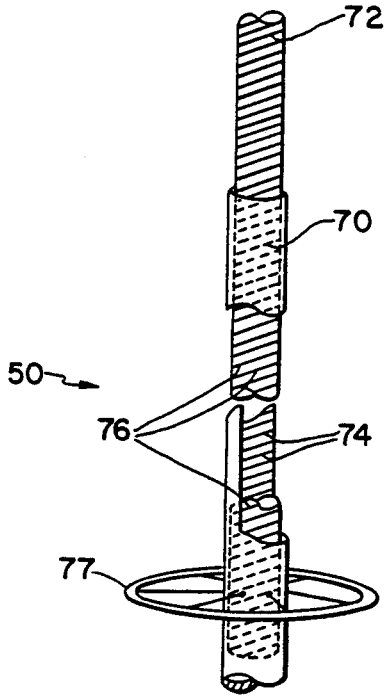
FIG. 6 is a side view, partly cut away, of a portion of a telescoping mast which may be used with the present invention.

As mentioned previously, when the luff boom 52 is in a tilted position, the tack end thereof and the foot boom 30 are raised higher above the deck 14 and cabin roof 20 than when the luff boom 52 is in an untilted position. A sailboat rigged according to the present invention can take advantage of this additional clearance to lower the center of effort CE of the mainsail 32. This can be accomplished by building the mast 50 in two or more round telescoping sections 70 and 72 as shown in FIG. 6. The outer section 70 makes up the lower portion of the mast 50 and includes screw threads 74 on its inside surface. The inside section 72 makes up the upper portion and includes screw threads 76 on its outside surface, the screw threads 76 being adapted to mate with the screw threads 74. The outer section 70 is mounted rotatably about its central vertical axis on bearings (not shown), and a large wheel 77 is rigidly attached to, and concentrically with, the outer section 70. The inner section 72 is prevented from rotating by means not shown. A mast so built can be extended or retracted as desired by rotating the wheel 77 in one direction or the other, as appropriate, thereby keeping the center of effort CE as close as possible to the center of mass of the boat. Alternatively, the mast can be extended so as to move the sail higher, into a region of higher wind velocity. A motor may also be used in place of the wheel 77.

The general principles of the tilt sail rig can be applied also or instead to a jib or foresail with advantages similar to those for a mainsail. A unique advantage that the tilt sail principle confers on a jib is the ability to use a curved luff.

The conventional jib is disposed with the luff fastened along the forestay (which runs from the peak of the mast to some point at the bow on the centerline) and held straight by tightly securing it at the tack and peak. Rotation of the jib around the line of the luff is possible and the sail is trimmed by the sheet at the clew. However, the constraint of holding the luff of the sail means that no rotation of the jib other than around the forestay is possible.

An important function of the jib on a conventionally rigged sailboat is to modify and control the wind going past the mainsail. This is done by extending the foot of the (Genoa) jib creating a slot between the main and the jib so that the wind speed on the lee side of the mainsail is increased. While this modification improves the effectiveness of the mainsail, it does so at the expense of a large amount of sail area and results in a jib of low aspect ratio and, therefore, low aerodynamic force. Furthermore, a jib with a long foot is difficult to manipulate during tacking.

Figure 7:
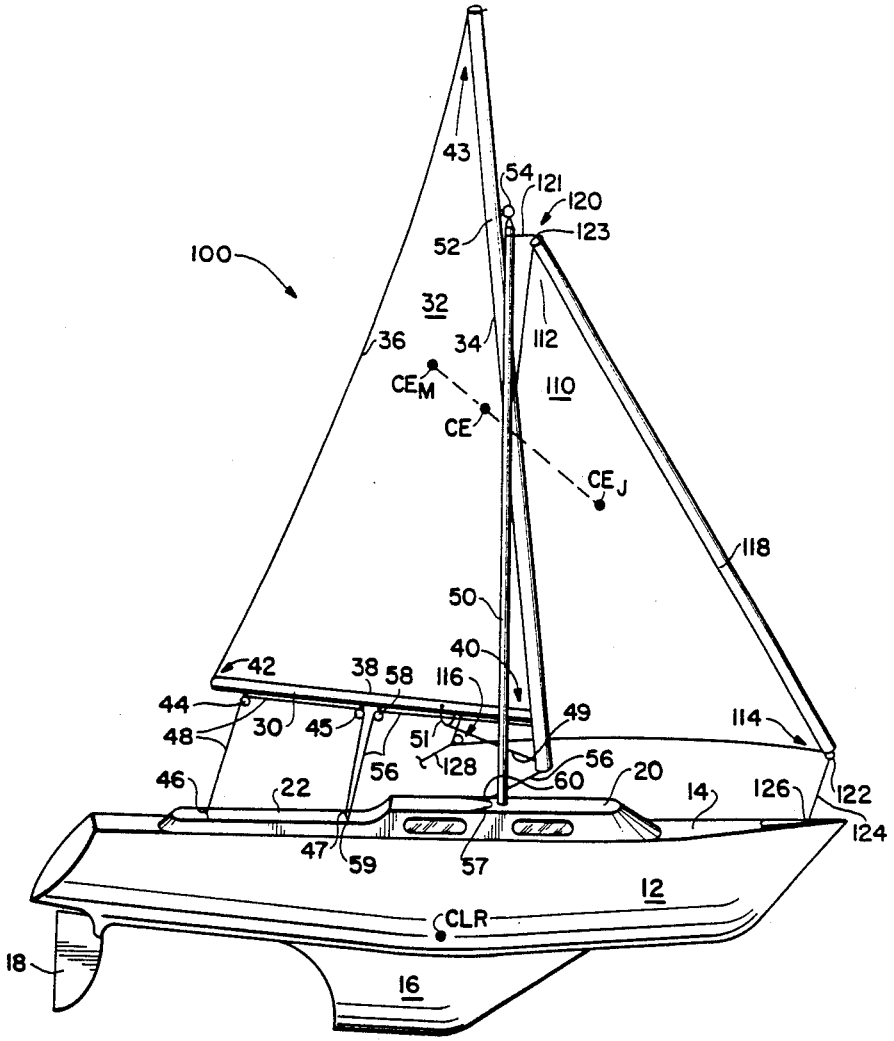
FIG. 7 is a side view of another sailboat according to the present invention.

An embodiment which applies the principles of the present invention to a jib will now be described. In FIG. 7, there is shown a sailboat 100 having a tilt-mounted mainsail 32 as described with respect to FIGS. 2 and 3. In addition, there is shown a jib 110 having a head 112, tack 114 and a clew 116. Fitted inside a pocket (not shown) formed in the luff edge of the jib 110 is a luff boom 118 with a teardrop-shaped cross section. The head end of the luff boom 118 is attached to the mast 50 near the top thereof by means of a joint 120. The joint 120 permits the jib 110 to tilt about an axis normal to the mast 50 and lying substantially in the plane of the sail, and also to rotate about an axis substantially coincident with the luff boom 118. This is accomplished by means of, for example, a ball and socket joint (not shown), or by suspending the top of the boom 118 by a snap hook and eye 123 from an arm 121 clamped near the top of the mast 50. Although not necessary to the invention, the luff boom 118 is also pivotable about an axis normal to the axes of tilt and rotation.

Attached to a shackle 122 at the tack end of the luff boom 118 is a tack sheet 124. Tack sheet 124 is threaded through a block 126 on the deck 14 near the bow and adjustably secured to a winch and cleat (not shown) near the cockpit 22. A clew sheet 128 is attached to the clew 116 of the jib 110 and is also adjustably secured near the cockpit 22 to a winch and cleat (not shown). Although not part of the present embodiment, the foresail rigging may also include a foot boom.

As with the mainsail 32, the jib 110 may be operated in a conventional mode by close hauling the tack sheet 124 and thereby preventing any tilt or pivoting of the luff boom 118. The advantages of the invention appear, however, when the tack sheet 124 is let out and the luff boom 118 is allowed to tilt outward or pivot forward. When running before the wind, the tack and clew sheets 124 and 128 for the jib 110 may be let out to position the jib similarly to the mainsail 32 as shown in FIG. 2. That is, the clew 116 is out to one side of the boat 100 and the tack end of the luff boom 118 tilts forward and upward (because the tilt axis lies above the center of effort $CE_J$ on the jib 110) to rest somewhat above and forward of the hull 12. If desired, the mainsail 32 can be set out to port (as shown in FIG. 2) and the jib 110 can be set out to starboard, or vice versa.

As with the mainsail 32, the total force of the wind acting on the jib 110 can be considered to act on a center of effort $CE_J$ and in a direction substantially perpendicular to an average plane of the sail. The force on the jib 110 in this position therefore has a component in the upward vertical direction relative to the boat 100. The vector sum of this force acting at $CD_J$, and that produced by the wind acting on the mainsail 32 at its center of effort $CE_M$, comprises the total force $F_T$ produced by the wind acting on the two sails 32 and 110. The total force $F_T$ acts effectively from a combined center of effort CE located on a line extending between the center of effort $CE_M$ on the mainsail 32 and the center of effort $CE_J$ on the jib 110. Since each force individually has a component directed vertically upward relative to the boat 100, so does the combined force $F_T$. Similarly to the one-sail embodiment previously described, this upward component tends to improve the longitudinal trim of the hull 12 by reducing the pitching torque, and also to reduce hull immersion by tending to lift the hull 12 out of the water.

When sailing close to the wind, again, the same advantages over conventionally rigged boats can be obtained as are obtained in the one-sail embodiment. This is accomplished by letting out the jib clew sheet 128 only enough to permit the clew 116 to swing a small distance out to port (assuming as before that the wind is coming from the starboard bow), and by letting out the jib tack sheet only enough to permit the luff boom 118 to tilt to port by a small angle. If the same is done with the mainsail 32, the total force $F_T$ acting at the center of effort CE will have an upward component relative to the water, or less of a downward component than in a conventional boat. The configuration improves longitudinal trim and directional balance, reduces hull immersion and heeling, and permits the boat 100 to sail closer to the wind than does a conventional design. Additionally, since the luff boom 118 can rotate about its longitudinal axis, it can always be rotated so that its leading edge is directed windward, thereby minimizing the disturbance of the wind flow on the lee side of the jib 110. Moreover, since all the above-described advantages reduce the drag of the hull 12 in the water, the present invention permits the use of a jib with a shorter foot and a higher aspect ratio than conventional designs. Alternatively, if the sailor so desires, a jib with a long foot may still be used to create a slot for passage of wind between it and the mainsail 32.

The principles of the present invention are also applicable to other sails, such as mizzens and staysails.

The invention has been described with respect to particular embodiments thereof, and one skilled in the art can now easily ascertain its essential characteristics. Various changes and modifications are possible to adapt it to various usages and conditions, all within the scope of the invention.

What is claimed is:

1. A sailing vehicle including a hull structure having a fore and aft centerline; a mast having a lower end and an upper end, the lower end of the mast being stepped in the hull structure at the centerline such that the mast is maintained in substantially fixed upright relation with respect to the hull structure; and a sail having three corners constituting a head, a tack and a clew, an edge constituting a luff extending between the head and the tack, a foot extending between the tack and the clew, and a center of effort located approximately at the geometric center of the sail, wherein the improvement comprises:

means for supporting the sail including a luff boom having an upper end and a lower end, the head of the sail being attached to the luff boom near the upper end of the luff boom and the tack of the sail being attached to the luff boom near the lower end of the luff boom;

means for articulately connecting the luff boom to the mast so as to permit the luff boom to tilt with respect to the mast and to pivot at least partially around the mast, the connecting means being coupled to the mast adjacent to the upper end of the mast and being attached to the luff boom at a point above the center of effort of the sail;

means directly connecting the lower end of the luff boom to a fixed point with respect to the hull structure for controlling the tilt angle of the luff boom with respect to the mast in response to wind pressure on the sail and angle of heel of the mast with respect to a vertical position, said means for articulately connecting the luff boom to the mast and said means for controlling the tilt angle of the luff boom with respect to the mast being the only means respectively connecting the luff boom to the mast and directly to a point fixed with respect to the hull structure; and means acting on the clew of the sail for controlling the angle of a line containing the clew and the tack of the sail with respect to a plane defined by the mast and the centerline of the hull.

2. A sailing vehicle according to claim 1 wherein the means for articulately connecting the luff boom to the mast is fixed to the upper end of the mast and to the luff boom at a point between the upper end of the luff boom and the intersection with the luff boom of a line orthogonal to the luff boom and passing through the center of effort of the sail.

3. A sailing vehicle according to claim 1 wherein the means for controlling the tilt angle of the luff boom with respect to the mast comprises an elongated flexible tensile member and means for controllably varying the length of said tensile member between the lower end of the luff boom and said point fixed with respect to the hull structure.

4. A sailing vehicle according to claim 3 wherein said point fixed with respect to the hull structure is located approximately on the centerline of the hull structure.

5. A sailing vehicle according to claim 1 wherein the upper end of the luff boom extends a substantial distance above the upper end of the mast.

6. A sailing vehicle according to claim 5 wherein said point fixed with respect to the hull structure is located aft of the mast.

7. A sailing vehicle according to claim 1 wherein the means for articulately connecting the luff boom to the mast is attached to the upper end of the luff boom, and said point fixed with respect to the hull structure is located forward of the mast.

8. A sailing vehicle according to claim 1 wherein the mast comprises means for telescopically extending and retracting the upper end of the mast relative to the lower end of the mast for controlling the height of the center of effort of the sail above the hull structure.

9. A sailing vehicle according to claim 1 wherein the means for articulately connecting the luff boom to the mast comprises a first member fixed to the upper end of the mast, a second member pivotally connected to the first member for rotation about a first axis parallel to the longitudinal axis of the mast, a third member pivotally connected to the second member for rotation about a second axis perpendicular to the first axis, and means for attaching the third member to the luff boom.

10. A sailing vehicle according to claim 9 wherein the means for attaching the third member to the luff boom comprises a fourth member pivotally connected to the third member for rotation about a third axis perpendicular to the second axis.

11. A sailing vehicle according to claim 1 wherein the luff boom has a streamlined cross section.

12. A sailing vehicle according to claim 1 wherein the sail supporting means includes a foot boom having a forward end connected to the luff boom near the lower end of the luff boom and a rearward end, the tack of the sail being attached to the foot boom near the forward end and the clew of the sail being attached to the foot boom near the rearward end.

13. A sailing vehicle according to claim 12 wherein the sail is generally triangular.

* * * * *